US005875682A

United States Patent [19]

Smith

[11] Patent Number: 5,875,682

[45] Date of Patent: Mar. 2, 1999

[54] OPERATOR CONTROLLED ELECTRICAL OUTPUT SIGNAL DEVICE

[75] Inventor: David P. Smith, Joliet, Ill.

[73] Assignee: Caterpillar Inc., Peoria, Ill.

[21] Appl. No.: 822,391

[22] Filed: Mar. 20, 1997

[51] Int. Cl.[6] ..... G05G 9/047

[52] U.S. Cl. ..... 74/471 XY; 74/527

[58] Field of Search ..... 74/471, 527, 531; 200/6 A; 273/148 B; 345/161

[56] References Cited

U.S. PATENT DOCUMENTS

| | | | |
|---|---|---|---|
| 3,556,270 | 1/1971 | Comment | 74/531 X |
| 4,103,559 | 8/1978 | Kohler | 74/471 XY |
| 4,926,172 | 5/1990 | Gorsek | 200/6 A X |
| 5,235,495 | 8/1993 | Blair et al. | 74/527 X |
| 5,436,638 | 7/1995 | Bolas et al. | 345/156 |
| 5,589,828 | 12/1996 | Armstrong | 74/471 XY |
| 5,638,866 | 6/1997 | Mueller | 137/636.2 |
| 5,655,411 | 8/1997 | Avitan et al. | 74/471 XY |
| 5,659,334 | 8/1997 | Yaniger et al. | 345/161 X |
| 5,767,840 | 6/1998 | Selker | 74/471 XY |

*Primary Examiner*—Charles A. Marmor
*Assistant Examiner*—Scott Lund
*Attorney, Agent, or Firm*—John W. Grant; J. W. Burrows

[57] ABSTRACT

Fore and aft movement of a lever pivots first and second shafts of a cross shaped member while left and right movement of the lever causes a yoke of the lever to pivot on third and fourth shafts of the cross shaped member. The pivotal movement of the first shaft causes a pair of end portions of a torsion spring to generate forces on a force sensor resulting in the output of electrical signals proportional to the fore and aft movement of the lever. Similarly, left and right pivotal movement of the yoke causes a pair of end portions of another torsion spring to generate forces on another force sensor resulting in the output of electrical signals proportional to the left and right movement of the lever. Selectively energizing a coil device fixed relative to a mounting base pulls a washer anchored to the second shaft into mechanical engagement with the coil device to hold the lever at a fore or aft operational position. Similarly, selectively energizing a coil device fixed relative to the yoke pulls a washer anchored to the forth shaft into mechanical engagement with another coil device to hold the lever at a left or right aft operational position.

7 Claims, 2 Drawing Sheets

OPERATOR CONTROLLED ELECTRICAL OUTPUT SIGNAL DEVICE

TECHNICAL FIELD

This invention relates generally to an electrical output signal device and, more particularly, to one for converting an operator input command into an electrical output signal.

BACKGROUND ART

Electrical joysticks or single axis levers are commonly used to convert operator input commands into electrical signals for controlling electrohydraulic valves of mobile machines. Heretofore, such devices designed to withstand the harsh environment of mobile machines have been expensive while the life of the less expensive devices is somewhat limited. Thus it would be desirable to provide an operator controlled electrical output signal device that is competitive with the known less expensive devices but has the same life and accuracy as the more expensive devices. It would also be desirable for the electrical output device having a variable operator feedback feel combined with a variable position hold feature.

DISCLOSURE OF THE INVENTION

In one aspect of the present invention, an operator controlled electronic output signal device comprises a base, a lever, a bore defined in either the base or the lever, and a pivot shaft extending through the bore and connected to the other of the base or lever and, a torsion spring positioned on the pivot shaft and having a pair of opposed end portions, a bracket assembly coupled to the pivot shaft to maintain a positional relationship with the pivot shaft, the bracket assembly including a pin extending between the end portions of the torsion spring, and a force sensor secured to either the base or the lever and extending between the end portions of the torsion spring.

The present invention is directed to overcoming one or more of the problems as set forth above.

BEST MODE FOR CARRYING OUT THE INVENTION

Figure 1:
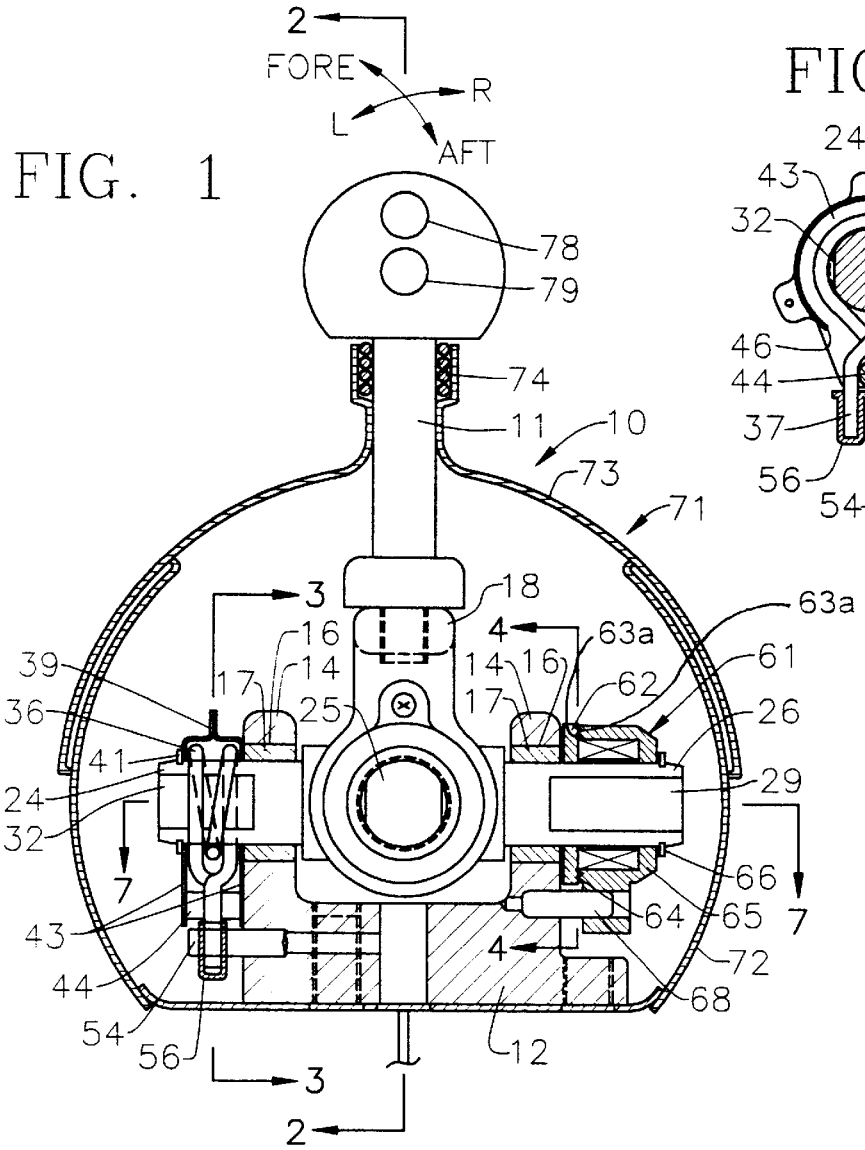
FIG. 1 is a diagrammatic sectional view of an embodiment of the present invention.

Referring now to the drawings, an operator controlled electrical output signal device 10 includes a lever arrangement 11 coupled to a mounting base 12 through a universal coupling 13. The mounting base 12 has a pair of spaced apart, upwardly extending lugs 14 defining a pair of axially aligned bores 16 each having a bearing 17 disposed therein. The lever arrangement 11 includes a U-shaped yoke 18 having a pair of downwardly extending lugs 19 defining a pair of axially aligned bores 21 each having a bearing 22 seated therein. The universal coupling 13 includes a member 23 having four pivot shafts 24–27 radiating outwardly from a central hub 28 in the shape of a cross to provide two axis of pivotal movement. The pivot shafts 24,26 extend through the bearings 17 seated in the lugs 14 of the mounting base 12, while the pivot shafts 25,27 extend through the bearings 22 of the yoke 18. A pair of parallel flat surfaces 29 are provided on the outer end portions of the shafts 25,26. Similarly, a pair of parallel flat surfaces 32 are provided on the shafts 24,27.

A torsion spring 36 is positioned on the pivot shaft 24 outboard of the lug 14 and has a pair of downwardly extending opposed end portions 37,38. A hollow bracket assembly 39 is suitably coupled to the shaft 24 and is retained on the shaft by a retainer 41. In this embodiment, the shaft extends through an opening 42 in the bracket assembly with the opening shaped to match the profile of the shaft 24 so that the bracket assembly is rotationally fixed relative to the shaft by the flat surfaces 32. The bracket assembly 39 includes individual halves 43 positioned on opposite sides of the torsion spring 36 and are suitably fastened together. A pin 44 is connected to the bracket assembly and extends between the end portions 37,38 of the torsion spring. A pair of stop surfaces 46,47 are formed on the bracket assembly and disposed for engagement with the torsion spring to limit rotational movement of the shaft.

Another torsion spring 48 is disposed on the shaft 27 outboard of one of the lugs 19 and has a pair of upwardly extending end portions 49,51. Another hollow bracket assembly 52 similar to the bracket assembly 39, described above, is coupled to the shaft 27 and carries a pin 53 which extends between the end portions 49,51 of the torsion spring 48.

A force sensor 54 is secured to the base 12 and extends outwardly between a pair of bushings 56 seated on the end portions 37,38 of the torsion spring 36. Another force sensor 57 is secured to the yoke 18 and extends outwardly between a pair of bushings 58 seated on the end portions 49,51 of the torsion spring 48.

An electromagnetic multi-position detent mechanism 61 is disposed on the shaft 26 outboard the lug 14 so that the lever 11 can be selectively retained at any one of a multiplicity of fore and aft operational positions. The detent mechanism 61 includes a ferrous washer 62 coupled to the shaft and having an annular face 63 facing an annular face 64 of an electromagnetic coil device 65 retained on the shaft 26 by an annular retainer 66. A central opening 67 extending through the washer has a profile matching the profile of the shaft 26 so that the washer is coupled or keyed to the shaft 26 for unitary rotation with the shaft 26 while permitting axial movement on the shaft 26. A pin 68 anchors the electromagnetic coil device 65 relative to the base 12 while permitting the shaft 26 to rotate relative to the coil device. The opposing faces 63 and 64 define a means 70 for mechanically interlocking the washer to the coil device. In this embodiment, the means 70 includes having matching serrated portions 63*a* formed on the faces 63,64 so that energizing the coil device pulls the washer 62 into mechanical engagement with the coil device to prevent rotation of the shaft 26 relative to the coil device. Alternatively, the faces 63,64 could be provided with other types of frictional engaging surfaces.

Another electromagnetic multi-position detent mechanism 69 is disposed on the shaft 25 for retaining the lever 11 at any one of a multiplicity of left and right operational positions. The detent mechanism 69 is similar to the detent mechanism 61, described above, with the exception that the electromagnetic coil device 65 of the detent mechanism 69 is anchored to the yoke 18 for movement therewith when the lever 11 is moved in the left or right direction.

The signal device 10 is enclosed within a dust cover 71 having a lower spherical portion 72 suitably fixed to the base 12 and an upper spherical portion 73 slidable on the lever 11 and resiliently urged into sliding contact with the lower spherical portion with a spring 74. A position indicia 75 is suitably positioned on the lower spherical portion 72 to provide a visual indication of the fore and aft and \or the left and right positions of the lever.

The lever arrangement 11 includes a handle 77 at its upper end. A pair of electrical switches 78,79 are disposed in the handle 77 to provide a means to energize the coil devices 65 in a conventional manner. The switches can be on\off or proportional, latching or non latching type.

Industrial Applicability

Figure 3:
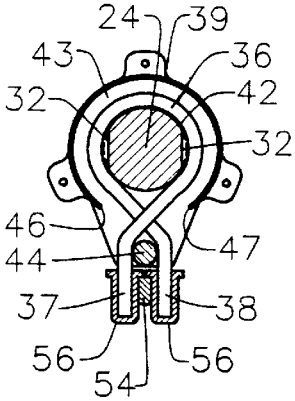
FIG. 3 is a sectional view taken along line 3—3 of FIG. 1.
Figure 4:
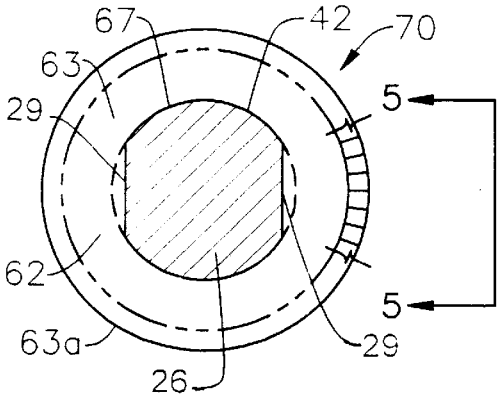
FIG. 4 is a somewhat enlarged sectional view taken along line 4—4 of FIG. 1.
Figure 5:
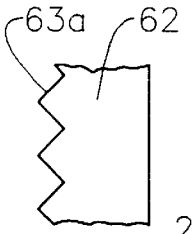
FIG. 5 is a greatly enlarged edge view taken generally along line 5—5 of FIG. 4.
Figure 7:
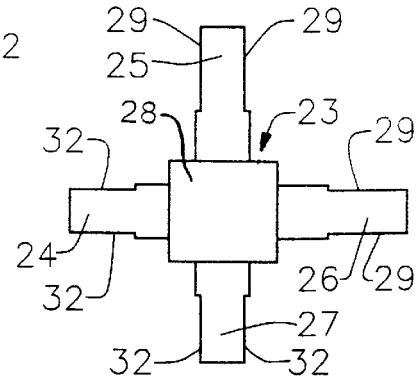
FIG. 7 is a sectional view taken along line 7—7 of FIG. 1.
Figure 2:
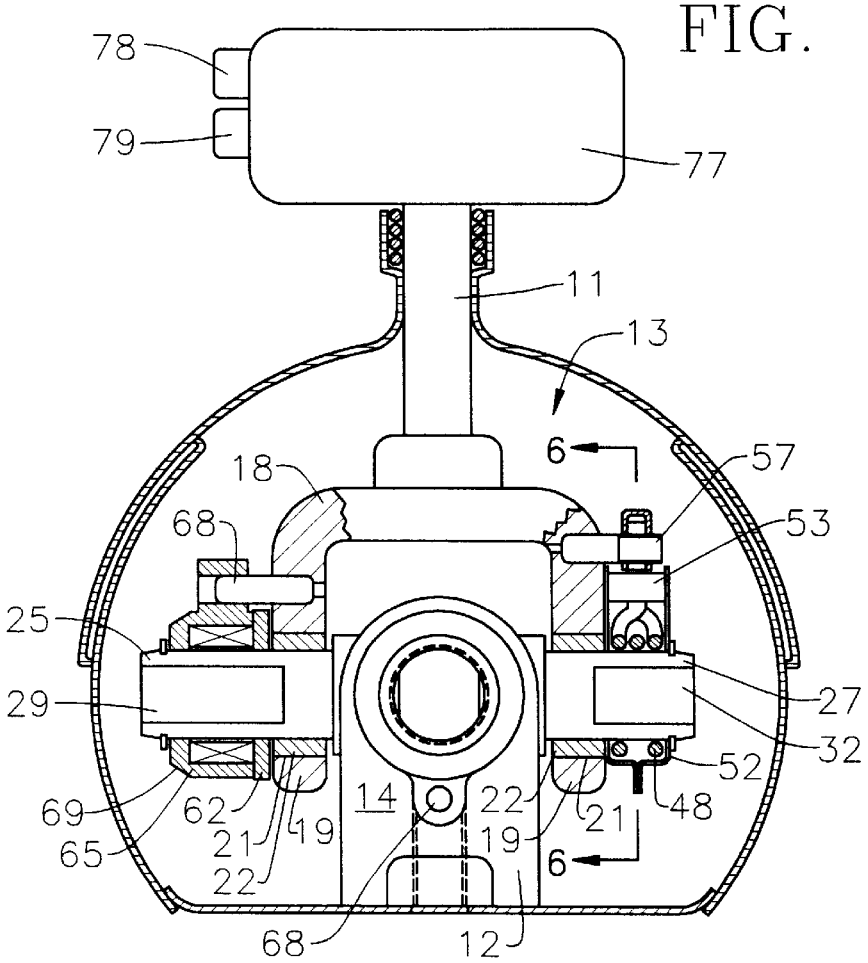
FIG. 2 is a sectional view taken along line 2—2 of FIG. 1.
Figure 8:
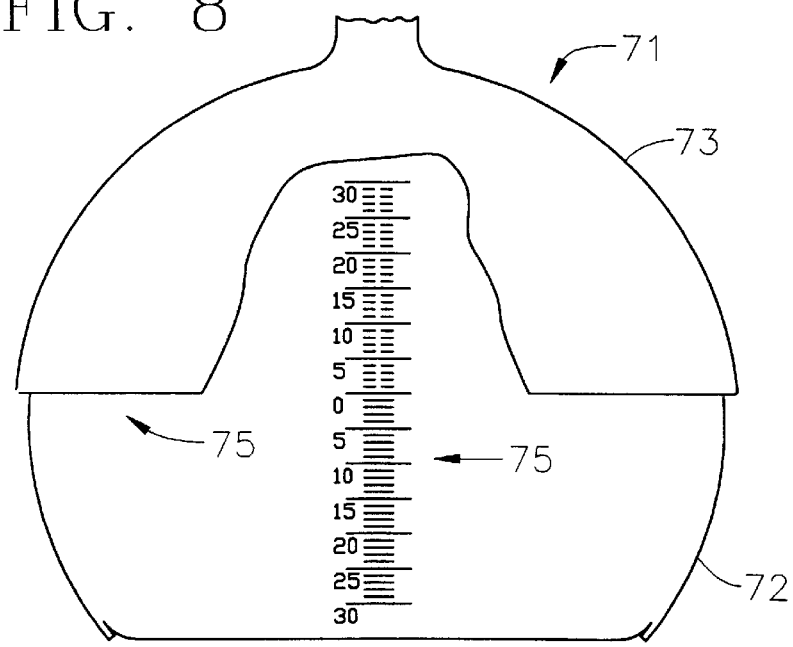
FIG. 8 is an elevational side view of FIG. 1.

In use, operation of the lever 11 in the fore and aft direction as indicated in FIG. 1 generates output signals from the force sensor 54 while operation of the lever in the left and right direction generates output signals from the force sensor 57. For example, movement of the lever in the fore direction rotates the shafts 24 and 26 of the cross-shaped member 23 and thus the bracket assembly 39 attached to the shaft 24 counterclockwise as viewed in FIG. 3. Counterclockwise movement of the bracket assembly 39 causes the pin 44 to drive the end portion 38 of the torsion spring 36 counterclockwise, resulting in the end portion 37 exerting a force on the force sensor 54. This results in the force sensor 54 outputting an electrical signal proportional to the angular movement of the lever 11. The electrical signal can be directed to a controller (not shown) for actuating any suitable electrically controlled device.

Similarly, moving the lever 11 in the aft direction causes the pin 44 to drive the end portion 37 of the torsion spring 36 clockwise, resulting in another electrical signal being outputted from the force sensor 57 proportional to the aft movement of the lever. The torsion spring 36 also functions as a centering spring for biasing the lever 11 from both the fore and aft positions to a preset or centered position.

Figure 6:
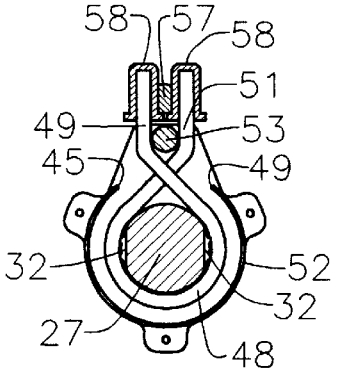
FIG. 6 is a sectional view taken along line 6—6 of FIG. 2.

Movement of the lever 11 in the leftward direction pivots the yoke 18 on the shafts 25 and 27 while the bracket assembly 52 remains stationary with the shaft 27. This causes the force sensor 57 to drive the end portion 49 of the torsion spring 48 counterclockwise as viewed in FIG. 6. The pin 53 prevents rotational movement of the end portion 51, thereby resulting in an electrical signal being output from the force sensor 57 proportional to the degree of leftward movement of the lever 11. Similarly, rightward movement of the lever 11 causes the force sensor 57 to drive the end portion 51 of the torsion spring 48 clockwise resulting in another electrical signal being outputted from the force sensor 57. Also, as noted above, the torsion spring 48 acts as a centering mechanism to bias the lever from both the left and right positions back to its centered position.

The detent mechanism 61 functions to retain the lever 11 at selected fore or aft operational positions. For example, energizing the coil device 65 of the detent mechanism 61 when the lever is at an actuated fore or aft position causes the washer 62 to be pulled into clamping engagement with the coil device 65 so that the serrations on the face 63*a* of the washer 62 mechanically interlocks with the matching serrations on the face 64 of the associated coil device 65. Since the washer 62 is coupled to the shaft 26 and the coil device 65 is fixed relative to the mounting base 12, the clamping engagement between the coil device and the washer holds the lever 11 at the position it occupies when the coil device 65 is energized.

The detent mechanism 69 functions in a similar manner to retain the lever 11 at a selected left or right position.

It will be appreciated that the amount of clamping or pulling force generated by the coil devices 65 can be varied by controlling the electrical current directed to the coil devices 65. Thus, under some situations, it may be desirable to energize the coil device with a relatively low current to provide a very light clamping force. This would then permit the lever 11 to be manually repositioned without deenergizing the coil device. The serrated surfaces provide the operator with a feel to permit very fine adjustment of the lever position.

The accuracy of the force sensor and thus the angle position signal can be enhanced by automatically calibrating the signal null and gain by using the derivative of the force signal with respect to the angle position for both start and end of lever stroke. The fit for use of the force sensor can be indicated by the amount and\or frequency of signal null and gain calibrations.

In addition to the operator on\off or proportional control of the coil current, an electronic controller can be used to vary the current. Examples of this includes reduced lever overshoot past the centered position when the lever is released, coil release when the engine is stopped, coil release when an implement reaches a desired position and coil energized to vary the feel or maximum lever travel for various modes of operation.

Single lever devices can also be configured by attaching the lever to the hub of a single axis shaft joint.

Other aspects, objects and advantages of this invention can be obtained from a study of the drawings, the disclosure and the appended claims.

It is claimed:

1. An operator controlled electrical output signal device for outputting an electrical signal proportional to pivotal movement of a lever comprising:

a base;

the lever;

a bore defined in one of the base or the lever;

a pivot shaft extending through the bore and connected to the other of the base or the lever;

a torsion spring positioned on the pivot shaft and having a pair of opposed end portions;

a bracket assembly coupled to the pivot shaft to maintain a positional relationship with the pivot shaft, the bracket assembly including a pin extending between the end portions of the torsion spring; and a force sensor secured to one of the base and the lever and extending between the end portions of the torsion spring.

2. The output signal device of claim 1 wherein the torsion spring cooperates with the force sensor to bias the lever to a preset position.

3. The output signal device of claim 2 wherein the bore is defined in the base, the shaft rotates with the lever and pivotally extends into the bore, and the force sensor is secured to the base.

4. The output signal device of claim 2 wherein the bore is defined in the lever, the shaft is connected to the base and pivotally carries the lever, and the force sensor is secured to the lever.

5. The output signal device of claim 2 wherein the base includes a pair of spaced apart lugs and a pair of axially aligned bores defined in the lugs, the pivot shaft extends through the bores, the lever is secured to the pivot shaft between the lugs, the torsion spring and the bracket assembly are positioned on the pivot shaft outboard of one of the lugs and including an electrically actuated variable position detent mechanism positioned on the pivot shaft outboard of the other lug and disposed to controllably retain the lever at a multitude of pivotal positions.

6. The output signal device of claim 5 wherein the detent mechanism includes a washer coupled to the pivot shaft and an electromagnetic coil device rotatably positioned on the pivot shaft adjacent the washer and anchored to one of the base and to the lever, the coil device having a de-energized position permitting relative rotation between the washer and the coil device and an energized position locking the coil device to the washer.

7. The output signal device of claim 6 wherein the washer and the coil have opposing faces and the face of one of the washer and the coil being serrated to mechanically interlock the opposing faces.

* * * * *